US010362859B2

(12) United States Patent
Duncan

(10) Patent No.: US 10,362,859 B2
(45) Date of Patent: Jul. 30, 2019

(54) ORAL CARE SYSTEM AND METHOD

(71) Applicant: COLGATE-PALMOLIVE COMPANY, New York, NY (US)

(72) Inventor: Kelly Gail Duncan, Washington, NJ (US)

(73) Assignee: Colgate-Palmolive Company, New York, NY (US)

( * ) Notice: Subject to any disclaimer, the term of this patent is extended or adjusted under 35 U.S.C. 154(b) by 109 days.

(21) Appl. No.: 15/503,648

(22) PCT Filed: Aug. 14, 2014

(86) PCT No.: PCT/US2014/051129

§ 371 (c)(1),
(2) Date: Feb. 13, 2017

(87) PCT Pub. No.: WO2016/024985

PCT Pub. Date: Feb. 18, 2016

(65) Prior Publication Data

US 2017/0245629 A1 Aug. 31, 2017

(51) Int. Cl.
*A46B 11/00* (2006.01)
*A46B 9/04* (2006.01)

(52) U.S. Cl.
CPC ..... *A46B 11/0062* (2013.01); *A46B 9/04* (2013.01); *A46B 2200/1066* (2013.01)

(58) Field of Classification Search
CPC ..... A46B 11/0062
USPC ..... 401/23, 24, 123, 202, 269
See application file for complete search history.

(56) References Cited

U.S. PATENT DOCUMENTS 4,503,871 A 3/1985 Mendenhall
4,844,641 A * 7/1989 Grosfilley ..... A46B 11/0003 401/176
6,290,417 B1 * 9/2001 Kaminski ..... A46B 7/023 401/123
6,648,641 B1 11/2003 Viltro et al.
8,398,326 B2 * 3/2013 Jimenez ..... A46B 11/001 401/282

(Continued)

FOREIGN PATENT DOCUMENTS

CN 201299255 9/2009
CN 201451978 5/2010

(Continued)

OTHER PUBLICATIONS

International Search Report and the Written Opinion of the International Searching Authority issued in international application PCT/US2014/051129 dated Apr. 15, 2015.

*Primary Examiner* — David J Walczak
*Assistant Examiner* — Joshua R Wiljanen

(57) ABSTRACT

An oral care system includes a toothbrush having a head and a handle, a reservoir containing an oral care material, and an applicator in fluid communication with the reservoir for dispensing the oral care material from the reservoir. A cover is mounted on the toothbrush and movable from a closed position covering the applicator to an open position exposing the applicator. In the open position, a user may dispense and apply the oral care material to an oral surface. The applicator may take various forms including a porous pad or roller(s). In one embodiment, the cover may be mounted on the handle of the toothbrush.

18 Claims, 5 Drawing Sheets

(56) References Cited

U.S. PATENT DOCUMENTS

| | | | | |
|---|---|---|---|---|
| 8,491,210 | B2 | 7/2013 | Storz et al. | |
| 9,179,765 | B2 | 11/2015 | Klausegger et al. | |
| 9,723,913 | B2 | 8/2017 | Jimenez et al. | |
| 9,743,750 | B2 | 8/2017 | Boyke et al. | |
| 2006/0133885 | A1* | 6/2006 | Kaminski | A46B 11/0058 401/125 |
| 2011/0318085 | A1 | 12/2011 | Alcocer | |
| 2012/0275841 | A1 | 1/2012 | Jimenez et al. | |
| 2013/0291325 | A1 | 11/2013 | Jimenez et al. | |
| 2017/0295916 | A1 | 10/2017 | Jimenez et al. | |

FOREIGN PATENT DOCUMENTS

| | | |
|---|---|---|
| CN | 202311935 U | 7/2012 |
| CN | 202820097 | 3/2013 |
| WO | 2008/062935 | 5/2008 |
| WO | 2011/035011 | 3/2011 |
| WO | 2011/078863 | 6/2011 |
| WO | 2014/062186 | 4/2014 |
| WO | WO 2014/062184 | 4/2014 |
| WO | WO 2014/092699 | 6/2014 |

* cited by examiner

ORAL CARE SYSTEM AND METHOD

BACKGROUND

The present invention relates to oral care systems and related methods, and more particularly to a system and method including a toothbrush and an applicator for dispensing a fluidic oral care material contained in the toothbrush.

Oral care materials or agents may be applied in variety of ways. For tooth whitening products, for example, a common technique used for applying tooth whitening products is to cast an impression of a person's teeth and provide a tray of the shape of this impression. A user then adds a whitening composition to the tray and applies the tray to his/her teeth. The tray is left in place for a period of time and then removed. Another technique is to use a whitening strip that has a whitening composition on one surface. This strip is applied to a person's teeth and left in place for a period of time. Yet another technique is to apply a whitening composition to teeth using a small brush. This brush is repeatedly dipped back into the container during the application of the tooth whitening composition to one's teeth. After a few treatments, the teeth gradually whiten using the foregoing techniques.

The foregoing approaches to oral care material storage, dispensing, and application may not be convenient and readily portable for travel. The oral care product is typically stored separately from the oral care tooth cleaning implements such as a toothbrush and treated as distinct parts of an oral care regimen which must be handled and packed separately.

A more portable, compact, and convenient way to store, dispense, and apply oral care materials to oral surfaces is desired.

BRIEF SUMMARY

According to an embodiment, an oral care system includes a toothbrush defining a longitudinal axis and including a head and a handle coupled to the head, a reservoir disposed in the toothbrush and containing an oral care material, and an applicator disposed in the toothbrush in fluid communication with the reservoir. The applicator is operable to dispense the oral care material from the reservoir. A cover is movably mounted on the toothbrush, and movable from a closed position covering the applicator to an open position exposing the applicator. In one embodiment, the cover is slidably movable on the toothbrush between the open and closed positions.

According to another embodiment, a toothbrush includes a longitudinal axis, a head, a handle coupled to the head and including a reservoir configured for holding an oral care material, and an applicator disposed in the handle in fluid communication with the reservoir. The applicator is operable to dispense the oral care material from the reservoir. An axially elongated cover is movably mounted on the handle and movable from a closed position covering the applicator to an open position exposing the applicator. In one embodiment, the cover is slidably movable on the toothbrush between the open and closed positions.

A method for dispensing oral care material is provided. The method includes: providing a toothbrush comprising a longitudinal axis, a reservoir containing an oral care material, an applicator in fluid communication with the reservoir, and a cover movably mounted on the toothbrush and covering the applicator; moving the cover from a closed position covering the applicator to an open position; exposing the actuator; and dispensing oral care material from the actuator.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Referring to FIGS. 1, 2, 2A, and 2B, an oral care system 100 according to the present invention includes an oral care device such as toothbrush 200 and an oral care material applicator 300. In one embodiment, the applicator 300 may be integrally housed in the toothbrush 200 as further described herein. Furthermore, in certain embodiments the applicator 300 may be fixed to the toothbrush 200 so that the applicator 300 is non-detachable from the toothbrush 200. Because the applicator 300 is stored within the toothbrush 100, the oral care system 100 is highly portable for travel, easy to use, and reduces the amount of required luggage space. Furthermore, by housing the toothbrush 200 and applicator 300 together, the user is less likely to misplace the applicator 300 and more inclined to maintain the oral treatment routine with the applicator since brushing will remind the user to simply detach and apply the contents of the applicator 300 to complete the oral care treatment regimen.

In exemplary embodiments, the oral care material M may include without limitation the following types of flowable compositions in fluid form: tooth whitening, antibacterial, enamel protection, anti-sensitivity, anti-inflammatory, anti-attachment, fluoride, tartar control/protection, flavorant, sensate, colorant and others. However, other embodiments may be used to store and dispense any suitable type of flowable oral care material M. Accordingly, the invention is expressly not limited to any particular type of oral care material M.

Figure 1:
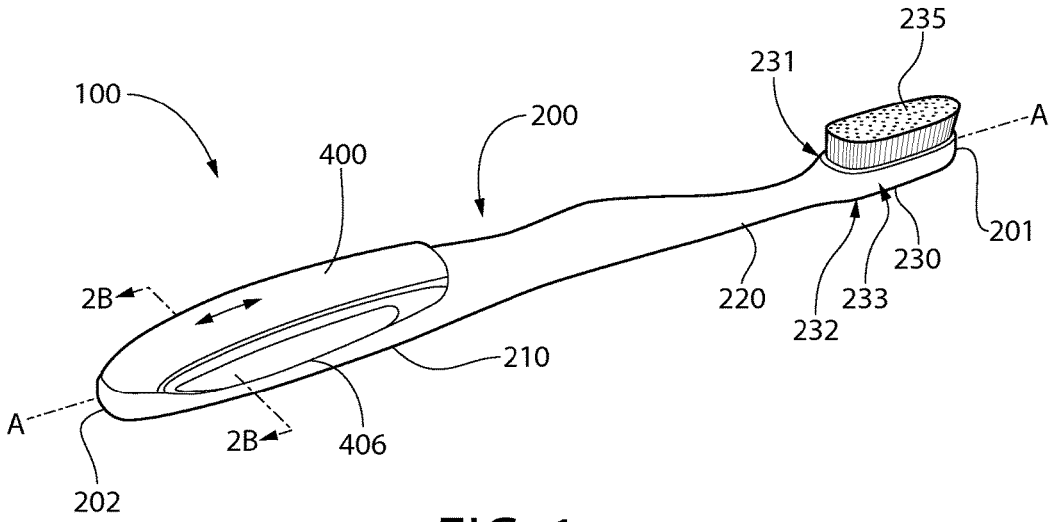
FIG. 1 is a perspective view of an oral care system including a toothbrush with a reservoir for storing an oral care material and a slidable cover shown in the closed position.
Figure 2:
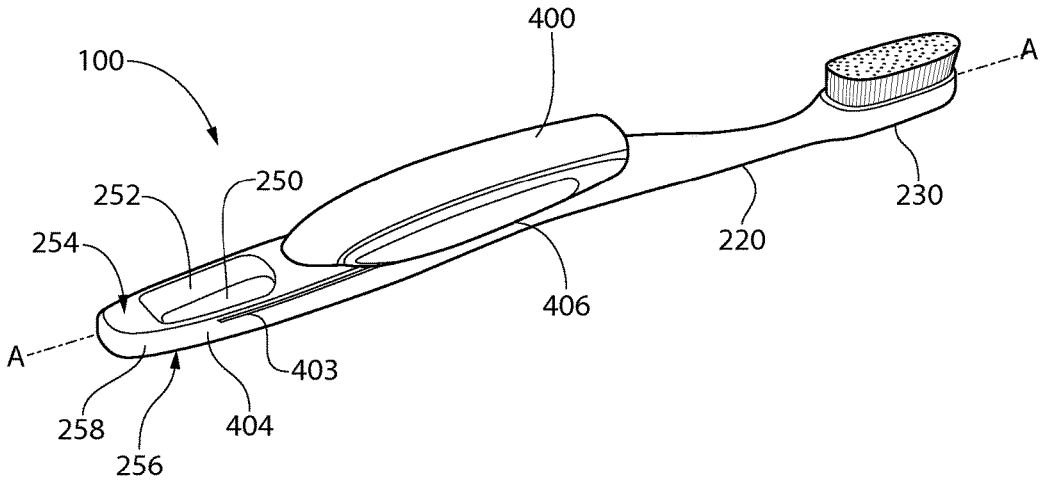
FIG. 2 is a perspective view thereof showing the cover in the open position to expose the reservoir.
Figure 3:
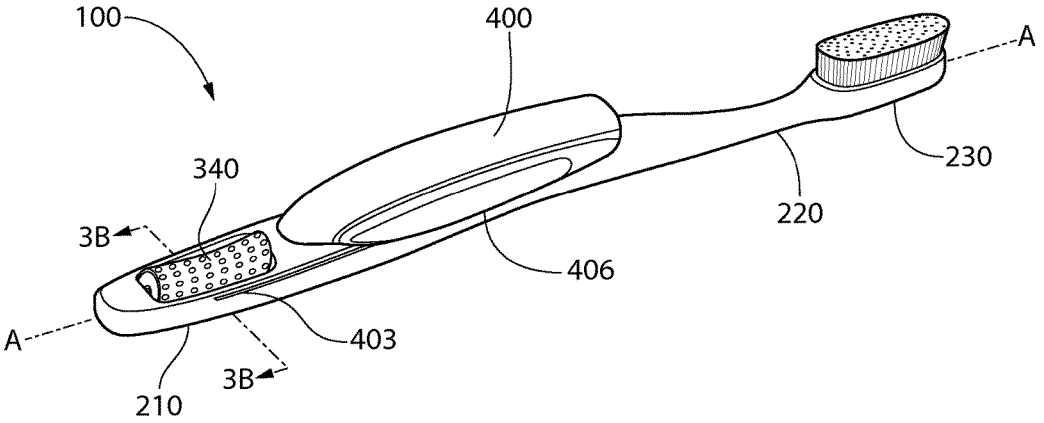
FIG. 3 is a perspective view of the toothbrush showing a second embodiment of an applicator.
Figure 3A:
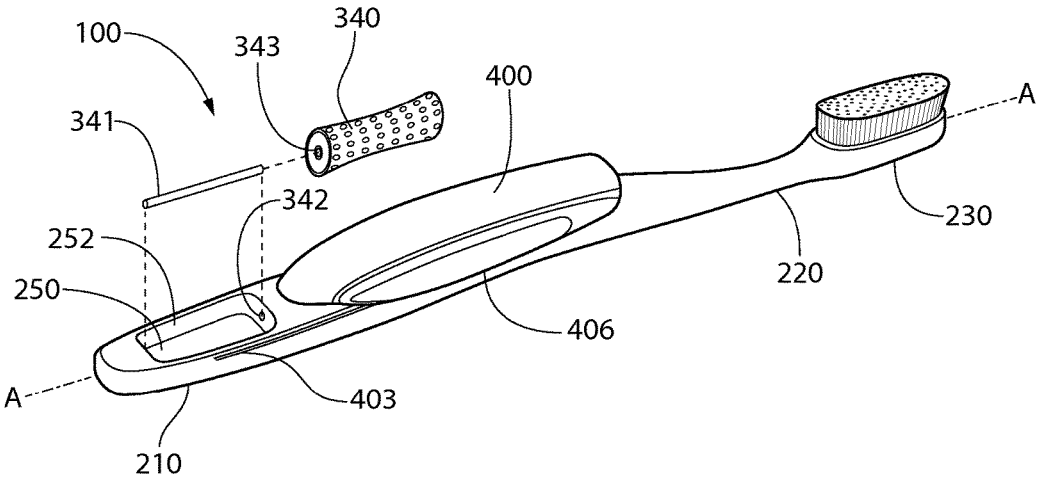
FIG. 3A is an exploded view thereof.
Figure 3B:
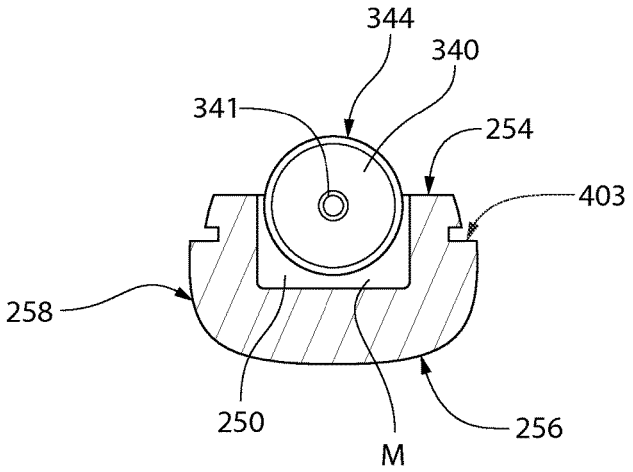
FIG. 3B is a transverse cross-sectional view of the toothbrush taken along lines 3B-3B in FIG. 3.

With continuing reference to FIGS. 1-3, the toothbrush 200 has an elongated body and generally includes a handle 210, a neck 220 and a head 230. Toothbrush 200 defines a longitudinal axis A-A extending between distal end 201 and proximal end 202. The handle 210 is configured for gripping by a user to manipulate the toothbrush 200 during brushing. Handle 210 may be formed of many different shapes, sizes, and materials formed by a variety of manufacturing methods that are well-known to those skilled in the art. If desired, the handle 210 may include a suitable textured grip made of soft elastomeric material. The handle 210 can be a single or multi-part construction. The handle 210 extends axially from a proximal end 212 to a distal end 213 along longitudinal axis A-A of the toothbrush 200.

Handle 210 includes a front surface 254, rear surface 256, and opposing lateral side surfaces 258 extending between the front and rear surfaces. In one embodiment, handle 210 may be an elongated and at least partially hollow structure defining an internal reservoir 250 for containing an oral care material. Reservoir 250 includes an outwardly facing and extending opening 252 to allow dispensing of the oral care material to a user. While the opening 252 may be located in front surface 254 of toothbrush handle 210 in the exemplified embodiment, the opening 252 may be located at other positions on the handle 210 in other embodiments of the invention. For example, the opening 252 may be located in the rear surface 256 or either of the lateral side surfaces 258. Opening 252 may be axially elongated in one embodiment having a rectangular or oblong shape in top plan view.

The handle 210 transitions into the neck 220 in moving towards the distal end 201 of the toothbrush 200. While the neck 220 generally may have a smaller transverse cross-sectional area than the handle 220, the invention is not so limited. Broadly speaking, the neck 220 is merely the transition region between the handle 210 and the head 230 and can conceptually be considered as a portion of the handle 210 or a portion of the head 230. The head 230 and/or neck 220 may therefore be considered as connected to the distal end 213 of the handle 210.

The head 230, neck 220, and handle 210 of toothbrush 200 may be formed as a single unitary structure using a molding, milling, machining or other suitable process known in the art. However, in other embodiments, handle 210 and head 230 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Whether the head 230, neck 200, and handle 210 are of a unitary or multi-piece construction (including connection techniques) is not limiting of the present invention. In some embodiments of the invention, a replaceable type head 230 may be provided which is detachably mounted to the handle 210 (along with a portion of neck 220) using techniques known in the art, such as disclosed in PCT International Patent Application No. PCT/US2012/042973 filed Jun. 18, 2012, which is incorporated herein by reference in its entirety.

Head 230 generally includes a front surface 231, a rear surface 232 and a peripheral side surface 233 that extends between the front and rear surfaces 231, 232. The front surface 231 of the head 230 includes a plurality of oral cleaning elements such as tooth engaging elements 235 extending therefrom for cleaning and/or polishing contact with an oral surface and/or interdental spaces. While the tooth engaging elements 235 are suited for brushing teeth, the tooth engaging elements 235 can also be used to polish teeth instead of or in addition to cleaning teeth. As used herein, the term "tooth engaging elements" is used in a broad generic sense to refer to any structure that can be used to clean, polish or wipe the teeth and/or soft oral tissue (e.g. tongue, cheek, gums, etc.) through relative surface contact. Common examples of "tooth engaging elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

Tooth engaging elements 235 of the present invention can be connected to the head 230 in any manner known in the art. For example, staples/anchors, in-mold tufting (IMT) or anchor free tufting (AFT) could be used to mount the cleaning elements/tooth engaging elements. In AFT, a plate or membrane is secured to the brush head such as by ultrasonic welding. The bristles extend through the plate or membrane. The free ends of the bristles on one side of the plate or membrane perform the cleaning function. The ends of the bristles on the other side of the plate or membrane are melted together by heat to be anchored in place. Any suitable form of cleaning elements may be used in the broad practice of this invention. Alternatively, the bristles could be mounted to tuft blocks or sections by extending through suitable openings in the tuft blocks so that the base of the bristles is mounted within or below the tuft block.

Figure 2A:
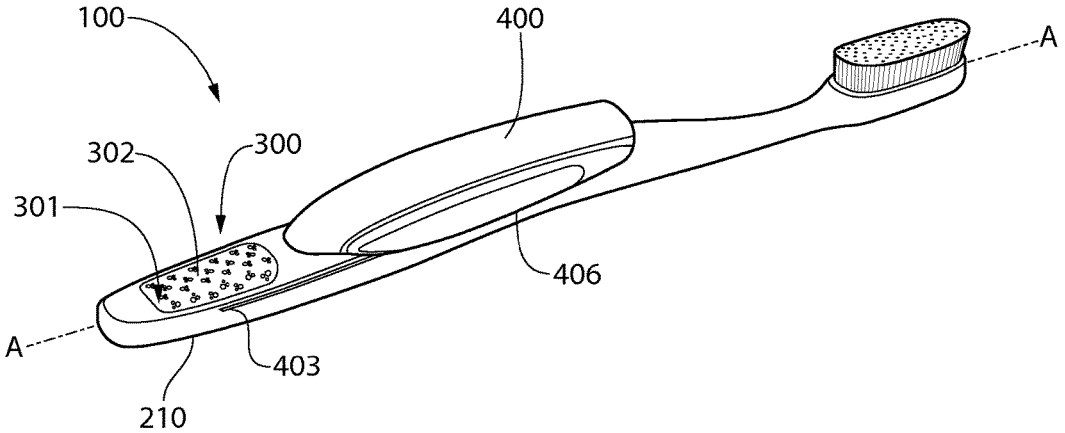
FIG. 2A is a perspective view thereof showing one embodiment of an applicator disposed in the reservoir.
Figure 2B:
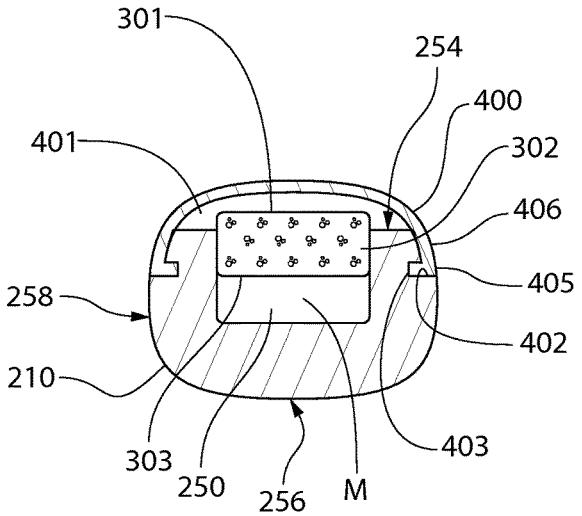
FIG. 2B is a transverse cross-sectional view of the toothbrush taken along lines 2B-2B in FIG. 1.

In one non-limiting embodiment shown in FIGS. 2A and 2B, applicator 300 may comprise a porous pad 302 which is in fluid communication with the oral care material M in reservoir 250. Pad 302 may be insertably disposed in opening 252 of the reservoir 250. The pad 302 has an exposed outer surface 301 and an inner surface 303 in contact with oral care material in the reservoir 250. In one embodiment, the outer surface 301 may extend above front surface 254 of handle 210 (best shown in FIG. 2B) to facilitate application of the oral care material to an oral surface of the user. Pad 302 may completely fill opening 252 of the reservoir 250 to prevent leakage of the oral care material M from the reservoir 250. In this configuration, the only flow path from the reservoir 250 may be through the pad 302.

Pad 302 may be formed of any suitable material capable of absorbing and/or wicking oral care material M from the reservoir 250 and in turn dispensing the material from the outer surface 301 of the pad to a user. The oral care material is transported and dispensed through the pad 302 (which closes the reservoir opening 252) and outer surface 301 to an oral surface of the user. In some examples, pad 302 may be made of an absorbent porous sponge type material including as without limitation foams such as urethane foams.

With continuing reference to FIGS. 1 and 2 (inclusive of all subparts), toothbrush 200 further includes an axially elongated movable cover 400. In one embodiment, cover 400 has an axial length greater than the axial length of the reservoir opening 252. In one embodiment, cover 400 may be slidably disposed on toothbrush handle 210 and configured for axial movement along the longitudinal axis A-A. Cover 400 is slidably movable from a closed position covering applicator 300 (see, e.g. FIG. 1) to an open position exposing the application for dispensing oral care material M (see, e.g. FIG. 2A). Cover 400 defines an internal cavity 401 configured to receive and enclose applicator 300.

In one embodiment, cover 400 may include an opposing pair of inwardly projecting mounting protrusions 402 which engage mating axially elongated grooves 403 formed in the lateral sides 258 of toothbrush handle 210. Grooves 403 may be linear in configuration and aligned along longitudinal axis A-A. In one embodiment, mounting protrusions 402 may configured as elongated rails having a greater axial length than lateral width. The grooves 403 may have an axial length sufficient to allow the applicator 300 to be completely exposed in one embodiment. The grooves 403 may further have a length in certain embodiments so that the grooves are completely hidden beneath cover 400 when in the closed position. The opposing closed axial ends 404 of grooves 403 may act a travel stops which limit the forward and rearward range of motion of the cover 400.

In one embodiment, the mounting protrusions 403 may be exposed on downwardly extending flanges 406 formed on either lateral side 406 of the cover 400. The flanges 406 may be axially elongated and constructed to be resiliently flexible in a lateral direction (i.e. transverse to longitudinal axis A-A). This lateral flexibility facilitates initially assembling the cover 400 to the toothbrush handle 210 by stretching the cover when inserted down and over the handle (i.e. transverse to the longitudinal axis A-A). The flanges deflect laterally outwards and then spring/snap back inwards when the mounting protrusions 402 become vertically and axially aligned with the grooves 403. Accordingly, in one embodiment the cover 400 is snap fit onto the toothbrush handle 410.

In use, a user may slide cover 400 distally from the closed position (FIG. 1) to the open position (FIG. 2A) to uncover the applicator 300. The applicator 300 may then be pressed against and/or wiped across the target oral surfaces to dispense and deposit oral care material M. When finished applying the oral care material, the user slides the cover 400 proximally back to the closed position.

FIGS. 3, 3A, 3B, and 3C depict an alternative embodiment of an applicator in the form of roller applicator 340. Applicator 340 includes an axial passageway 343 that receives pin 341 for rotatably mounting the applicator to the toothbrush handle 210. In one embodiment, the ends of pin 341 may be received in opposing holes 342 formed in the handle 210 adjacent to distal and proximal sides of the opening 252. Other methods for rotatably mounting applicator 340 to the handle 210 may be provided. Applicator 340 is positioned in reservoir 250 and rotates in opening. The top exposed surface 344 and adjacent upper portion of the applicator 340 may project above the top surface 254 of the toothbrush handle 210 to facilitate application of oral care material to an oral surface of the user. The unexposed lower portion of the applicator may be in contact with and partially immersed in the oral care material in the reservoir 250. In operation, the roller-type applicator 340 rotates as a user presses and rolls the applicator against and across the oral surface respectfully thereby applying the material. The lower portion of the applicator 340 is continually re-wetted with oral care material in the reservoir 250 as the roller rotates.

Applicator 340 may be formed of any suitable porous or non-porous material. A non-limiting example of an absorbent porous material that may be used is foam such as urethane (polyurethane) foam. Such roller applicators both absorb oral care material M from reservoir 250, rotate, and dispense the material to the target oral surface of the user. A non-limiting example of a non-porous material that may be used is rubber. In this latter construction, the roller applicator 340 may have a textured outer surface to facilitate capturing oral care material from the reservoir 250, holding the material, and dispensing the material to the oral care surface.

In the non-limiting exemplary illustration in FIG. 3, the single roller-type applicator 340 and pin 341 are oriented parallel to the longitudinal axis A-A. The applicator 340 is elongated having a greater axial length (measured in the direction parallel to the pin 341 which defines an axis of rotation) than width (measured in the direction perpendicular to the longitudinal axis A-A). In other possible orientations, the applicator 340 and pin 341 may be oriented transverse to the longitudinal axis A-A in which the roller has a length (now oriented perpendicular to the longitudinal axis A-A) that may be greater than the width (now oriented parallel to the longitudinal axis A-A).

Figure 4:
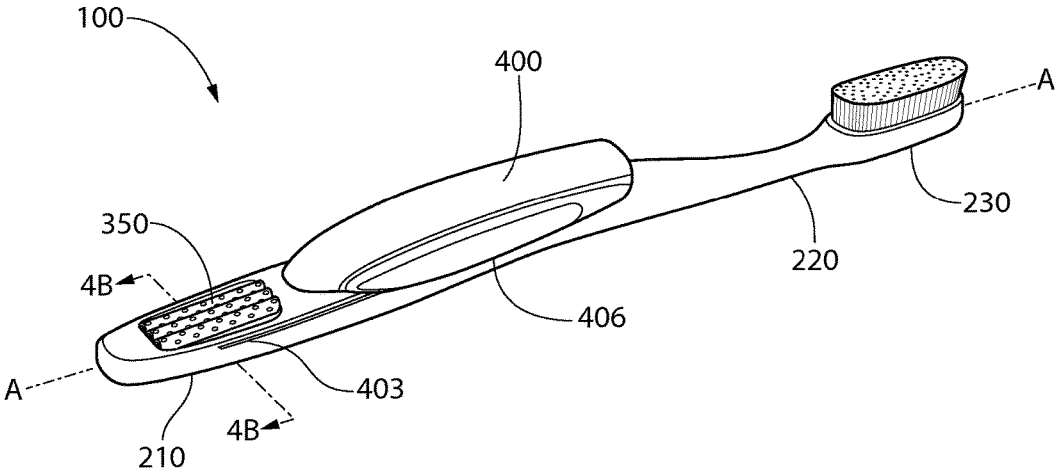
FIG. 4 is a perspective view of the toothbrush showing a third embodiment of an applicator.
Figure 4A:
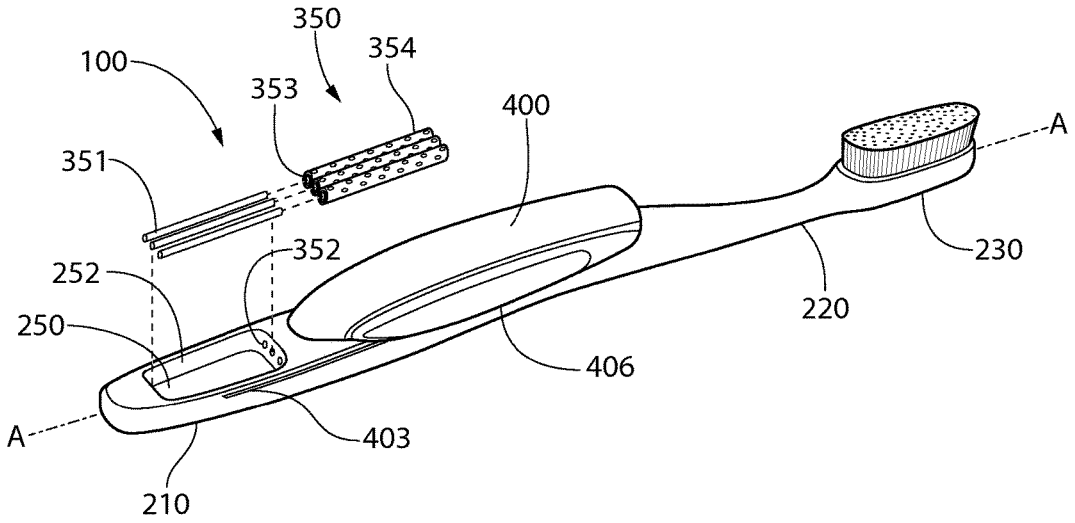
FIG. 4A is an exploded view thereof.
Figure 4B:
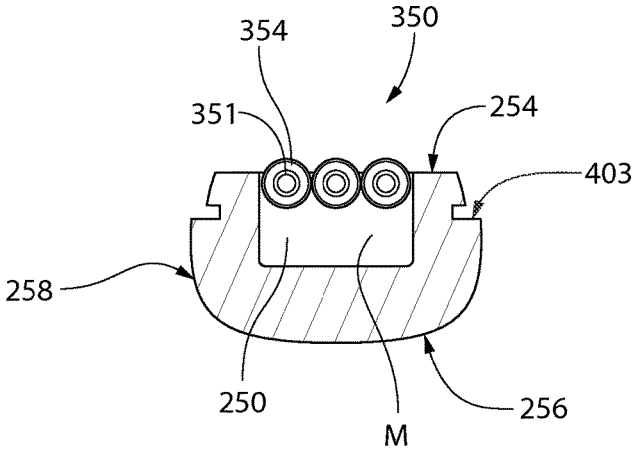
FIG. 4B is a transverse cross-sectional view of the toothbrush taken along lines 4B-4B in FIG. 4.

FIGS. 4 and 4A depict an alternative embodiment of an applicator in the form of a multiple roller applicator 350. Each of the rollers 354 may independently be configured, constructed, and function similarly to roller-type applicator 340 described herein. Rollers 354 each include an axial passageway 353 that receives a pin 351 for rotatably mounting the rollers to the toothbrush handle 210. In one embodiment, the ends of pin 351 may be received in opposing holes 352 formed in the handle 210 adjacent to distal and proximal sides of the reservoir opening 252. Other methods for rotatably mounting rollers 354 to the handle 210 may be provided.

Applicator rollers 354 may be formed of any suitable porous or non-porous material. In one embodiment, the rollers 354 may be made of foam. Although applicator 350 shown in the figures includes three rollers 354, any number of rollers more or less than three may be provided in various embodiments.

In the non-limiting exemplary illustration in FIG. 4, the rollers 354 of the multiple roller-type applicator 350 and pin 351 are oriented parallel to the longitudinal axis A-A. The rollers 354 are elongated having a greater length (measured in the direction parallel to the pin 351 which defines an axis of rotation) than width (measured in the direction perpendicular to the longitudinal axis A-A). In other possible orientations, the rollers 354 and pin 351 may be oriented transverse to the longitudinal axis A-A in which the rollers have a length (now oriented perpendicular to the longitudinal axis A-A) that may be the same as or greater than the width (now oriented parallel to the longitudinal axis A-A).

A method for dispensing oral care material M from a toothbrush 100 will now be summarized from the foregoing description. A toothbrush 100 is provided having a reservoir 250 containing oral care material M. The cover 400 is initially located in the storage or closed position (see, e.g. FIG. 1). To expose the applicator (e.g. applicators 300, 340, or 350), the user slides cover 400 distally towards the distal end 201 of the toothbrush to the dispensing or open position (see, e.g. FIG. 2A, 3, or 4). This uncovers the applicator which is now ready for use. The applicator 300/340/350 wetted with oral care material from the reservoir may then be pressed against, wiped or rolled across a target oral surface of the user to apply the material. The target oral surface may be without limitation for example the teeth, gums, cheeks, tongue, or any other oral surface. When finished applying the oral care material, the user slides the cover 400 towards the proximal end 202 of the toothbrush to the closed position again.

In some uses, it will be appreciated that a user may manually add oral care material M to the applicators 300/340/350 in addition to or instead of using the reservoir 250 in the toothbrush handle 210. In some embodiments, the toothbrush 100 and reservoir 250 may be configured to be refillable with oral care material M either by directly adding replacement oral care material through opening 252 into the reservoir, or alternatively by providing a capped sealable port which is in fluid communication with the reservoir.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care system comprising:

a toothbrush defining a longitudinal axis and including a head and a handle coupled to the head;

a reservoir disposed in the toothbrush, the reservoir containing an oral care material;

an applicator disposed in the toothbrush in fluid communication with the reservoir, the applicator operable to dispense the oral care material from the reservoir;

a cover movably mounted on the toothbrush, the cover movable from a closed position covering the applicator to an open position exposing the applicator;

wherein the cover remains attached to the toothbrush between the closed and open positions.

2. The oral care system according to claim 1, wherein the cover is slidably movable on the toothbrush between the open and closed positions.

3. The oral care system according to claim 1, wherein the cover includes an opposing pair of inwardly projecting mounting protrusions that slidably engage a mating pair of elongated grooves formed in the toothbrush.

4. The oral care system according to claim 3, wherein the protrusions are each formed on one of an opposing pair of flanges disposed on lateral sides of the toothbrush.

5. The oral care system according to claim 1, wherein the applicator is disposed on the handle.

6. The oral care system according to claim 1, wherein the applicator is configured as a porous pad configured to retain and dispense the oral care material.

7. The oral care system according to claim 1, wherein the applicator includes a roller.

8. The oral care system according to claim 1, wherein the reservoir includes an outwardly extending opening in which the applicator is disposed.

9. The oral care system according to claim 1, wherein the cover is axially movable along the longitudinal axis between the closed and open positions.

10. The oral care system according to claim 1, wherein the cover has an axially elongated shape.

11. A toothbrush comprising:

a longitudinal axis;

a head;

a handle coupled to the head and including a reservoir configured for holding an oral care material;

an applicator disposed in the handle in fluid communication with the reservoir, the applicator operable to dispense the oral care material from the reservoir;

an axially elongated cover movably mounted on the handle, the cover movable from a closed position covering the applicator to an open position exposing the applicator;

wherein the cover remains attached to the toothbrush between the closed and open positions.

12. The toothbrush according to claim 11, wherein the reservoir includes an outwardly extending opening in which the applicator is disposed.

13. The toothbrush according to claim 11, wherein the cover is slidably movable on the toothbrush between the open and closed positions.

14. The toothbrush according to claim 11, wherein the cover includes an opposing pair of inwardly projecting mounting protrusions that slidably engage a mating pair of elongated grooves formed in the toothbrush, wherein the protrusions are each formed on one of an opposing pair of flanges disposed on lateral sides of the toothbrush.

15. The oral care system according to claim 11, wherein the applicator includes one or more rollers.

16. A method for dispensing oral care material, the method comprising:

providing a toothbrush comprising a longitudinal axis, a reservoir containing an oral care material, an applicator in fluid communication with the reservoir, and a cover movably mounted on the toothbrush and covering the applicator;

moving the cover from a closed position covering the applicator to an open position;

exposing the applicator; and dispensing oral care material from the applicator;

wherein the cover remains attached to the toothbrush between the closed and open positions.

17. The method according to claim 16, wherein the moving step includes axially sliding the cover from the closed position to the open position.

18. The method according to claim 17, further comprising axially sliding the cover from the open position to the closed position and covering the applicator.

* * * * *